US005881547A

United States Patent [19]

Chiou et al.

[11] Patent Number: 5,881,547

[45] Date of Patent: Mar. 16, 1999

[54] CONDUCTING YARN

[75] Inventors: Hsin-Hsiung Chiou, Taipei; Sheng-Fu Chiu, Tainan Hsien; Jung-Kuei Liu, Taipei; Chi-Chag Wu, Changhua, all of Taiwan

[73] Assignee: China Textile Institute, Taipei Hsien, Taiwan

[21] Appl. No.: 85,833

[22] Filed: May 28, 1998

[51] Int. Cl.[6] ..... D02G 3/36

[52] U.S. Cl. ..... 057/216; 57/212; 57/213; 57/222; 57/230; 57/901

[58] Field of Search ..... 57/210, 212, 213, 57/216, 222, 230, 901

[56] References Cited

U.S. PATENT DOCUMENTS

| | | | |
|---|---|---|---|
| 3,291,897 | 12/1966 | Bramley | 57/901 |
| 3,639,807 | 2/1972 | McCune | 57/901 |
| 3,678,675 | 7/1972 | Klein | 57/901 |
| 4,647,495 | 3/1987 | Kanayama et al. | 428/246 |
| 4,776,160 | 10/1988 | Rees | 57/210 |
| 4,777,789 | 10/1988 | Kolmes et al. | 57/210 |
| 5,632,137 | 5/1997 | Kolmes et al. | 57/212 |

FOREIGN PATENT DOCUMENTS

| | | | |
|---|---|---|---|
| 3227422 | 10/1991 | Japan | 57/210 |

*Primary Examiner*—William Stryjewski
*Attorney, Agent, or Firm*—Rosenberg, Klein & Bilker

[57] ABSTRACT

The present invention relates to conducting yarn. The conducting yarn of the invention mainly consists of a strand of nonconductive yarn crossedly wrapped with two stainless steel threads. The yarn made in this way has better softness, high impact strength, and good conducting properties, and is especially adaptable for use in fencing jackets.

1 Claim, 2 Drawing Sheets

CONDUCTING YARN

SUMMARY OF THE INVENTION

Conventional conducting yarn structure as shown in FIG. 1 is a strand of nonconductive yarn covered with a layer of thin metal conducting foil (12). The width of the foil ranges from 1 to 2 millimeters and gives the yarn a conducting property. The conducting yarn is further woven together with average nonconductive yarn into conducting fabric for use in special applications. As an illustrative example, fabrics used for making conducting fencing jackets must have sufficient strength. The circuit of electrical scoring devices connected to a fencer must use the conduction property of fencing jackets. The strength of clothes is provided by woven yarn having high tensile strength. Therefore, a fencer usually has to wear three clothes during a match. It is rather inconvenient. In addition, thin foil wrapping around yarn makes fabric less flexible. It is desirable to have improvements made on conventional yarn structure.

In view of the above problems, the invention is to provide an innovative conducting yarn structure that uses a strand of yarn wrapped with two crossed conducting stainless steel threads to produce a conducting yarn thread having high strength and good conduction properties. The yarn structure of the invention has superior tensile strength and meets the requirements of making fencing jackets.

Now the structure and features of the invention will be described below in detail with reference to the accompanying drawings.

BRIEF DESCRIPTION OF THE ACCOMPANYING DRAWINGS

DETAILED DESCRIPTION OF PREFERRED EMBODIMENTS

Figure 1:
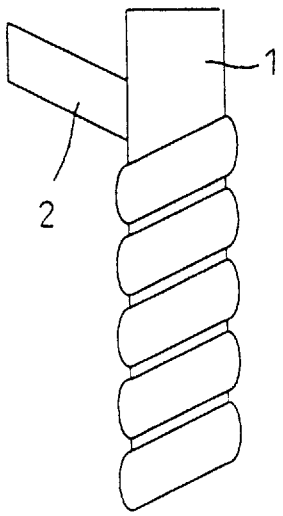
FIG. 1 (prior art)
FIG. 1 is a schematic view showing the construction of conventional conducting yarn.
Figure 2:
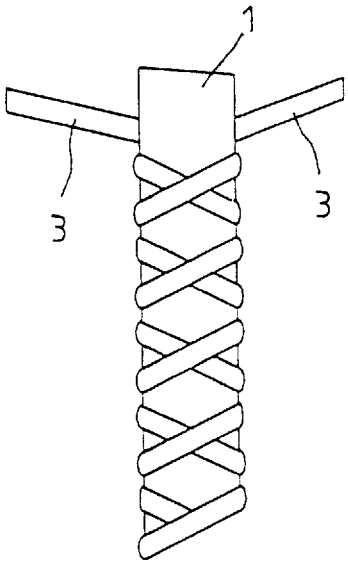
FIG. 2 shows the construction of conducting yarn according to the invention.

Referring to FIG. 2, the invention uses guide wheels to wind two stainless threads (3) around a nonconductive yarn thread (1) in a way of crossing each other to form an incompletely shielded structure. Such a thread not only has good strength but also has superior conductivity due to stainless threads.

The preferred coil density of stainless steel threads around the conducting yarn according to the invention ranges from 100 to 500 coils per meter. The diameters of preferred stainless steel threads are between 0.06 and 0.12 centimeter. The counts of nonconductive yarn (3) are preferably between 500 and 3000 deniers. With above combinations, the counts of conducting yarn can reach more than 1000 deniers and the fabric has a surface electric resistance below 5 ohms. A fencing jacket made of such fabric has high conductivity and strength while it is soft and comfortable for wearers due to its fine woven structure.

The yarn structure according to the invention indeed has the following advantages.

1. Stainless steel threads have good conductivity and the material is easy-to-acquire. The present invention does not have environmental issues, not like prior arts that use nonconductive yarn plated with metal. Thus the invention can significantly reduce material and manufacturing costs.

2. The conducting yarn structure according to the invention includes a strand of nonconductive yarn enveloped with two stainless steel threads and thus the fabric has greater strength than conventional conducting yarn fabric.

3. Conventional conducting yarn is made up of nonconductive yarn covered with an outer layer of thin metal foil and so it has higher rigidity and greater thickness. Such yarn is detrimental to production equipment of downstream manufacturing processes. The conducting yarn according to the invention uses thinner stainless steel threads and thus the fabric products have better softness. Therefore, it would not damage production equipment.

4. Cloth made of the inventive yarn appears better glosses due to its unique yarn structure. Therefore, it is favorable for fencing jackets, which needs to be white.

Figure 3:
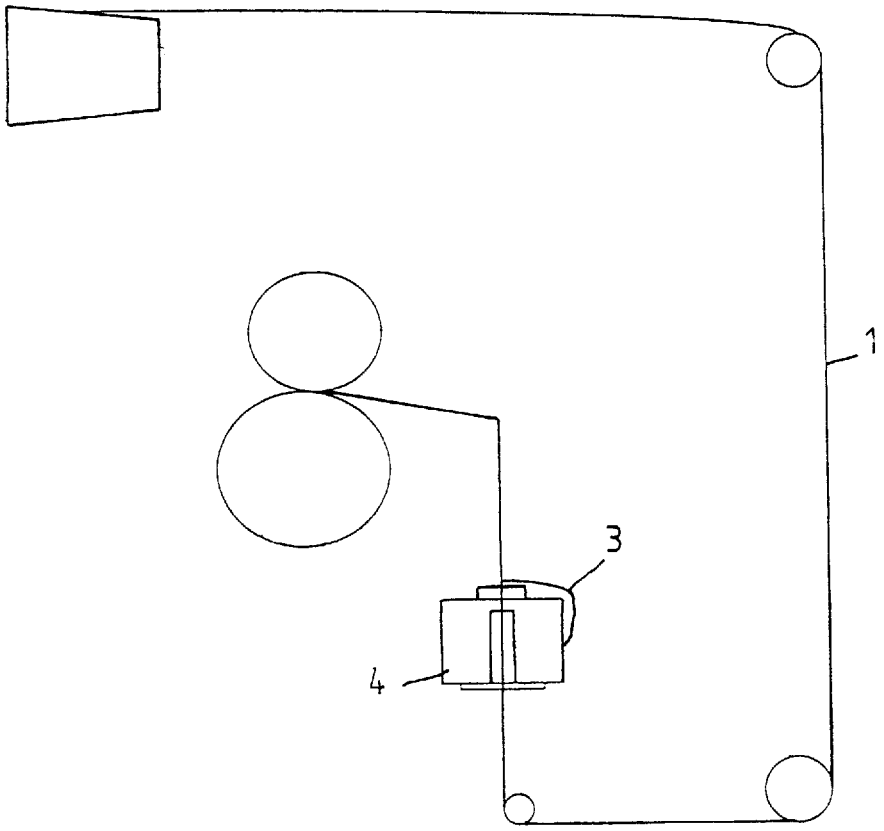
FIG. 3 depicts the manufacturing process of the conducting yarn according to the invention.

FIG. 3 illustrates a preferable manufacturing process of conductive yarn according to the invention, in which guide wheels lead nonconductive yarn (1) to an empty spindle (4). At the exit stainless steel threads wind around the nonconductive yarn (1) while spindle (4) rotates to form a semi-finished strand of yarn thread. Then the semi-finished yarn thread is processed with the above manufacturing procedure again while the empty spindle (4) rotates in an opposed direction. Thus another stainless steel thread (3) winds around the semi-finished yarn thread to form a strand of conductive yarn thread covered with two crossed stainless steel threads (3). The yarn made in this way is incompletely wrapped in stainless steel threads.

As described above, the innovative conducting yarn structure according to the invention evidently provides a better applicability that has never been found in a prior art yarn structure. We hereby file an application for a patent grant.

What is claimed is:

1. A conducting yarn structure comprising a strand of nonconductive yarn crossedly wrapped with two stainless steel threads to form twisted conducting yarn strings, which can be woven into conducting fabric, and characterized in that the coil density of stainless steel threads are between 100 and 500 coils per meter and the diameter of stainless steel threads ranges from 0.06 to 0.12 centimeter and the counts of nonconductive yarn are in the range of 500 to 3000 deniers; fabric made of such stainless steel threads having a surface electric resistance below 5 ohms and the counts of twisted conducting yarn being above 1000 deniers.

* * * * *